US008215047B2

(12) United States Patent
Ash, Jr. et al.

(10) Patent No.: US 8,215,047 B2
(45) Date of Patent: Jul. 10, 2012

(54) SYSTEMS AND METHODS FOR ADAPTING A VERTICAL FORE GRIP TO A USER

(75) Inventors: Gerald B. Ash, Jr., Newington, GA (US); Eric M. Rice, Rincon, GA (US)

(73) Assignee: Daniel Defense, Inc., Black Creek, GA (US)

( * ) Notice: Subject to any disclaimer, the term of this patent is extended or adjusted under 35 U.S.C. 154(b) by 270 days.

(21) Appl. No.: 12/694,958

(22) Filed: Jan. 27, 2010

(65) Prior Publication Data

US 2011/0179688 A1 Jul. 28, 2011

(51) Int. Cl.
*F41C 23/12* (2006.01)
*F41C 23/14* (2006.01)

(52) U.S. Cl. ..... 42/72; 42/71.01; 42/73; 42/90; 89/1.42

(58) Field of Classification Search ..... 42/71.01, 42/72, 73, 74, 75.01, 75.03, 85, 90; 89/1.42
See application file for complete search history.

(56) References Cited

U.S. PATENT DOCUMENTS

| | | | | |
|---|---|---|---|---|
| 63,303 | A * | 3/1867 | Restell | 42/69.01 |
| 445,192 | A * | 1/1891 | Nye et al. | 42/71.01 |
| 4,502,238 | A * | 3/1985 | Farrar et al. | 42/72 |
| 5,345,706 | A * | 9/1994 | Brown | 42/94 |
| 5,417,002 | A * | 5/1995 | Guerra | 42/72 |
| 5,903,995 | A * | 5/1999 | Brubach | 42/94 |
| 5,946,842 | A * | 9/1999 | Nyzell et al. | 42/72 |
| 6,658,781 | B1 * | 12/2003 | Bowen | 42/71.02 |
| 6,782,791 | B2 * | 8/2004 | Moore | 89/1.4 |
| 7,191,557 | B2 * | 3/2007 | Gablowski et al. | 42/72 |
| 7,240,448 | B2 * | 7/2007 | Knapp | 42/1.16 |
| 7,434,344 | B2 * | 10/2008 | Golan | 42/72 |
| 7,454,858 | B2 * | 11/2008 | Griffin | 42/71.01 |
| 7,464,495 | B2 * | 12/2008 | Cahill | 42/72 |
| 7,559,167 | B1 * | 7/2009 | Moody et al. | 42/72 |
| 7,568,304 | B1 * | 8/2009 | Moody et al. | 42/72 |
| 7,578,089 | B1 * | 8/2009 | Griffin | 42/71.01 |
| 7,658,029 | B1 * | 2/2010 | Moody et al. | 42/72 |
| 7,685,756 | B2 * | 3/2010 | Moody et al. | 42/72 |
| 7,698,847 | B2 * | 4/2010 | Griffin | 42/71.01 |
| 7,900,390 | B2 * | 3/2011 | Moody et al. | 42/72 |
| 7,937,875 | B1 * | 5/2011 | Berg | 42/72 |
| 7,954,271 | B1 * | 6/2011 | Bentley et al. | 42/71.01 |
| 8,056,277 | B2 * | 11/2011 | Griffin | 42/71.01 |
| 2005/0188588 | A1 * | 9/2005 | Keng | 42/72 |
| 2005/0241206 | A1 * | 11/2005 | Teetzel et al. | 42/72 |
| 2006/0191183 | A1 * | 8/2006 | Griffin | 42/72 |
| 2008/0052979 | A1 * | 3/2008 | Lee et al. | 42/94 |
| 2009/0044439 | A1 * | 2/2009 | Phillips et al. | 42/72 |
| 2009/0045304 | A1 * | 2/2009 | Faifer | 248/188.5 |
| 2009/0193702 | A1 * | 8/2009 | Lin | 42/72 |
| 2009/0223105 | A1 * | 9/2009 | Griffin | 42/72 |
| 2009/0313874 | A1 * | 12/2009 | Griffin | 42/72 |
| 2010/0031551 | A1 * | 2/2010 | Griffin | 42/72 |
| 2011/0167699 | A1 * | 7/2011 | Griffin | 42/72 |
| 2011/0173862 | A1 * | 7/2011 | Williams | 42/72 |

* cited by examiner

*Primary Examiner* — Michael David
(74) *Attorney, Agent, or Firm* — Sutherland Asbill & Brennan LLP

(57) ABSTRACT

A system and method for adapting a vertical fore grip to a user. In one embodiment, a system for adapting a vertical fore grip to a user can be provided. The system can include a vertical fore grip configured to adjustably attach to a firearm; a grip extension configured to modify the vertical fore grip, wherein the grip extension is further configured to mount at least one accessory; and a bolt assembly for adjustably attaching the grip extension to the vertical fore grip.

9 Claims, 7 Drawing Sheets

SYSTEMS AND METHODS FOR ADAPTING A VERTICAL FORE GRIP TO A USER

TECHNICAL FIELD

The disclosure relates generally to a firearm accessory, and more specifically to systems and methods for adapting a vertical fore grip to a user.

BACKGROUND OF THE INVENTION

Firearms such as rifles normally include a relatively elongated barrel encapsulated by a hand guard. The hand guard generally protects the user from the heat of the barrel during operation since, during operation, a user must grip some forward portion of the firearm to provide lateral and vertical control. The amount of control afforded by gripping the hand guard, however, is limited by the anatomic orientation of the human hand. The human hand, being better suited to grasp objects in a vertical orientation, when grasping the hand guard must do so in a horizontal orientation. This horizontally-oriented configuration can limit the user's ability to control the firearm. Consequently, conventional vertical fore grips have been developed to attach to firearms so that the user's control of the firearm can be improved.

One conventional vertical fore grip is a vertical grip designed to attach to the forward section of a firearm for grasping by the user's forward hand. When compared to conventional hand guards, a conventional vertical fore grip can enable a user to steady a firearm during operation and to resist recoil by providing a firmer grasping point. At the same time, conventional vertical fore grips can increase the amount of space available on the firearm since, in attaching to the forward portion of the firearm, the vertical fore grip can occupy less surface area than when compared to the human hand. Thus, by increasing the amount of available space on the firearm to the user, conventional vertical fore grips can enable a user to attach multiple accessories to a firearm in the remaining space and allows the user to adapt the firearm to operational requirements.

While conventional vertical fore grips have provided users with the ability to customize their firearms to their operational needs, they have generally not provided users with the ability to customize their firearms to themselves. When the user is a member of the military, police, or a private security organization, this can be a significant problem as firearms are not owned or operated by a single user, but may be randomly issued to many different users prior to a mission or training exercise. In such organizations, any individual user's physical features—such as height, arm length, hand size, and dexterity—can vary widely between users. In addition to these physical differences, individual users often have personal preferences for configuring their firearm to fit their own definition of comfort and needs. Conventional fore grips, however, provide little to no ability for users to adapt a firearm in these ways.

SUMMARY OF THE INVENTION

Systems and methods for adapting a vertical fore grip to a user can be provided by embodiments of the invention. In one embodiment, a method for adapting a vertical fore grip to a user can be provided. The method can include adjustably attaching a vertical fore grip to a firearm; modifying the vertical fore grip by attaching a grip extension to the vertical fore grip with a bolt assembly, wherein the grip extension is configured to mount at least one accessory; and adjusting the grip extension in relation to the vertical fore grip using the at least one bolt assembly.

In one embodiment, the method can also include mounting at least one accessory to the grip extension.

In one embodiment, adjustably attaching the vertical fore grip to a firearm can include adjusting the vertical fore grip along a length of the firearm.

In one embodiment, adjusting the grip extension in relation to the vertical fore grip can include rotating the grip extension in relation to the vertical fore grip.

In one embodiment, the method can include rotating the grip extension in relation to the vertical fore grip at a predetermined increment.

In one embodiment, the predetermined increment is about 22.5 degrees.

In another embodiment, a system for adapting a vertical fore grip to a user can be provided. The system can include a vertical fore grip configured to adjustably attach to a firearm; a grip extension configured to modify the vertical fore grip, wherein the grip extension is further configured to mount at least one accessory; and a bolt assembly for adjustably attaching the grip extension to the vertical fore grip.

In one embodiment, the vertical fore grip can also include a clamping mechanism for adjustable attachment to the firearm.

In one embodiment, the bolt assembly is configured to permit the grip extension to rotate in relation to the vertical fore grip.

In one embodiment, the grip extension can include a series of teeth, and the vertical fore grip comprises a series of ridges to interact with said teeth to control rotation of the grip extension in relation to the vertical fore grip.

In one embodiment, the ridges and teeth are configured to control rotation of the grip extension in relation to the vertical fore grip at a predetermined increment.

In one embodiment, the predetermined increment is about 22.5 degrees.

In another embodiment, an apparatus for use with a vertical fore grip can be provided. The apparatus can include a clamping mechanism operable to receive at least a portion of a firearm mounting rail; a plurality of lugs operable to mount to a corresponding plurality of grooves associated with the firearm mounting rail; and at least one tightening device operable to exert a pressure against the firearm mounting rail and to mount the vertical fore grip relative to the firearm mounting rail.

Other features and aspects of embodiments of systems and methods for adapting vertical fore grip to a user will be apparent or will become apparent to one with skill in the art upon examination of the following figures and detailed description. All other features and aspects, as well as other system and method embodiments, are intended to be included within the description and are intended to be within the scope of the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION OF EMBODIMENTS

The invention now will be described more fully hereinafter with reference to the accompanying drawings, in which example embodiments of the invention are shown. This invention may however, be embodied in many different forms and should not be construed as limited to the example embodiments set forth herein; rather, these embodiments are provided so that this disclosure will convey the scope of the invention to those skilled in the art. Like numbers refer to like elements throughout.

Figure 1:
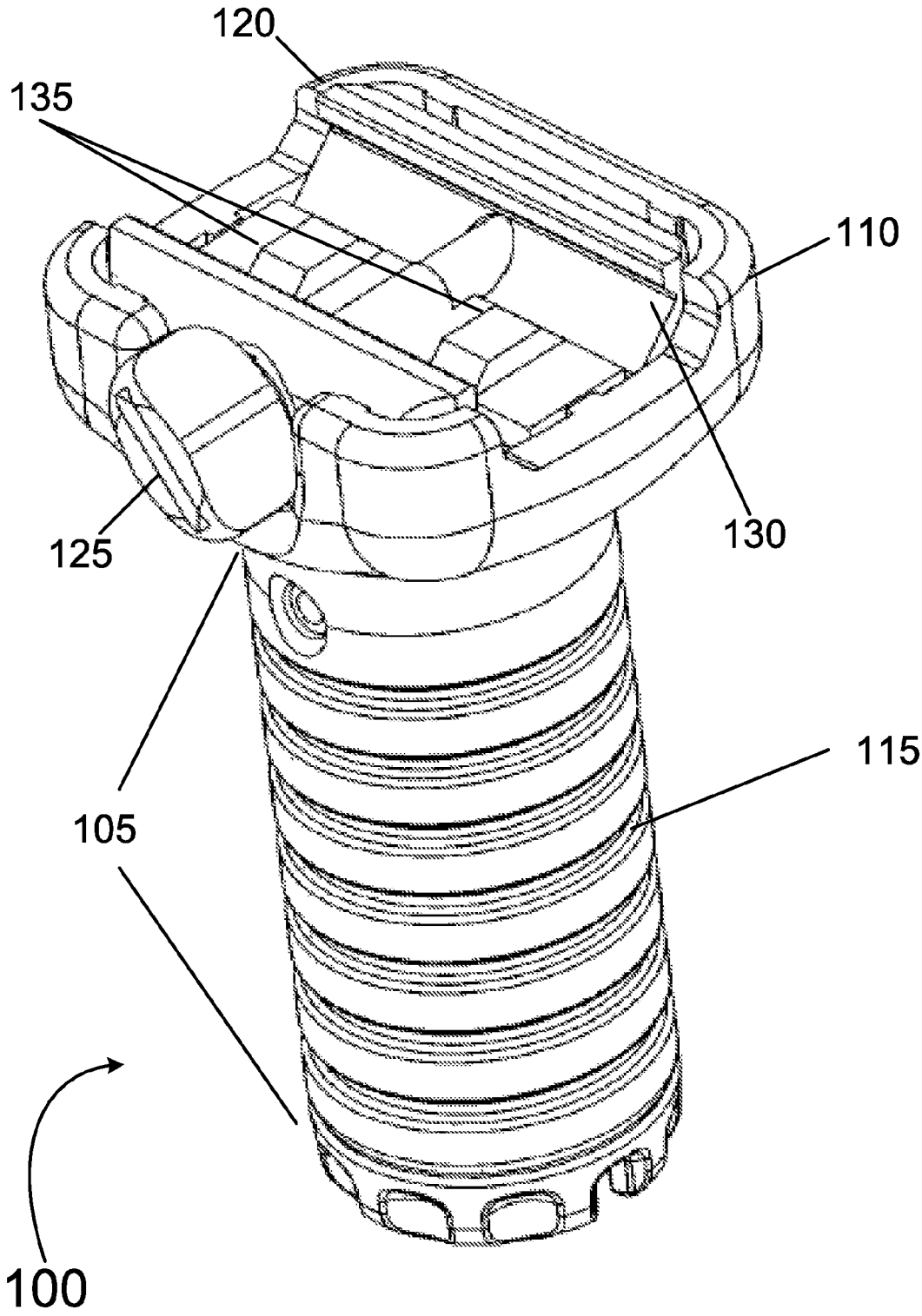
FIG. 1 illustrates a vertical fore grip according to one embodiment of the invention.

FIG. 1 illustrates a vertical fore grip 100 that may be provided according to one embodiment of the invention. Vertical fore grip 100 is a grip for vertical grasping by a user's hand when vertical fore grip 100 is attached to a firearm. Vertical fore grip 100 may include a fore grip section 105 of a first predetermined length with a mounting section or end 110 configured for attachment to a firearm. In the example embodiment, vertical fore grip 100 can be adapted for user comfort. For example, the fore grip section 105 is cylindrically shaped, which allows the user to rotate his firearm around barriers without shifting his grip. In addition to being cylindrical, fore grip section 105 is devoid of relatively sharp edges, which allows the user's hand to firmly grasp vertical fore grip 100 without fatigue.

With user comfort in mind, vertical fore grip 100 can also include any combination of ridges or grooves that can amplify the user's grip and/or reduce fatigue. This can be especially beneficial when the firearm is under full-auto fire since an improved grip can improve the user's grasp of the firearm, increasing retention and control. In the example embodiment, vertical fore grip 100 can include a plurality of annular grooves 115 encircling fore grip section 105. Grooves 115 can be positioned along the entire fore grip section 105 or grooves 115 can be positioned along only a portion of fore grip section 105. Grooves 115 may also reduce the weight of the vertical fore grip 100. The number and spacing of grooves 115 may vary, as can the number and spacing of ridges in other embodiments.

Vertical fore grip 100 can include a fore grip section 105 and a mounting end 110 that can be attached or coupled to a firearm. In one embodiment, mounting end 110 can be integrated into a hand guard assembly encapsulating the barrel of a firearm. Mounting end 110 can also be adapted to attach directly to the firearm, or indirectly through a rail assembly.

Rail assemblies provide a platform for attaching accessories to firearms. Rail assemblies usually conform to standards defined by a standards setting organization, like the U.S. government. One such rail assembly, defined according to MIL-STD-1913, is known as the "Picatinny" rail assembly. In the example embodiment, mounting end 110 is configured to quickly attach to a Picatinny rail assembly and to be easily adjusted by a user without special tools or equipment. In this way, vertical fore grip 100 can be quickly added to or removed from a firearm as operational requirements or as environmental conditions dictate. At the same time, adjustability affords the user the ability to customize the position of the grip according to his anatomical features, such as to accommodate arm length. Although the example embodiment references attachment to the Picatinny rail, it will be understood that other means of attachment to a firearm could also be used to provide one or more of these features.

Figure 2:
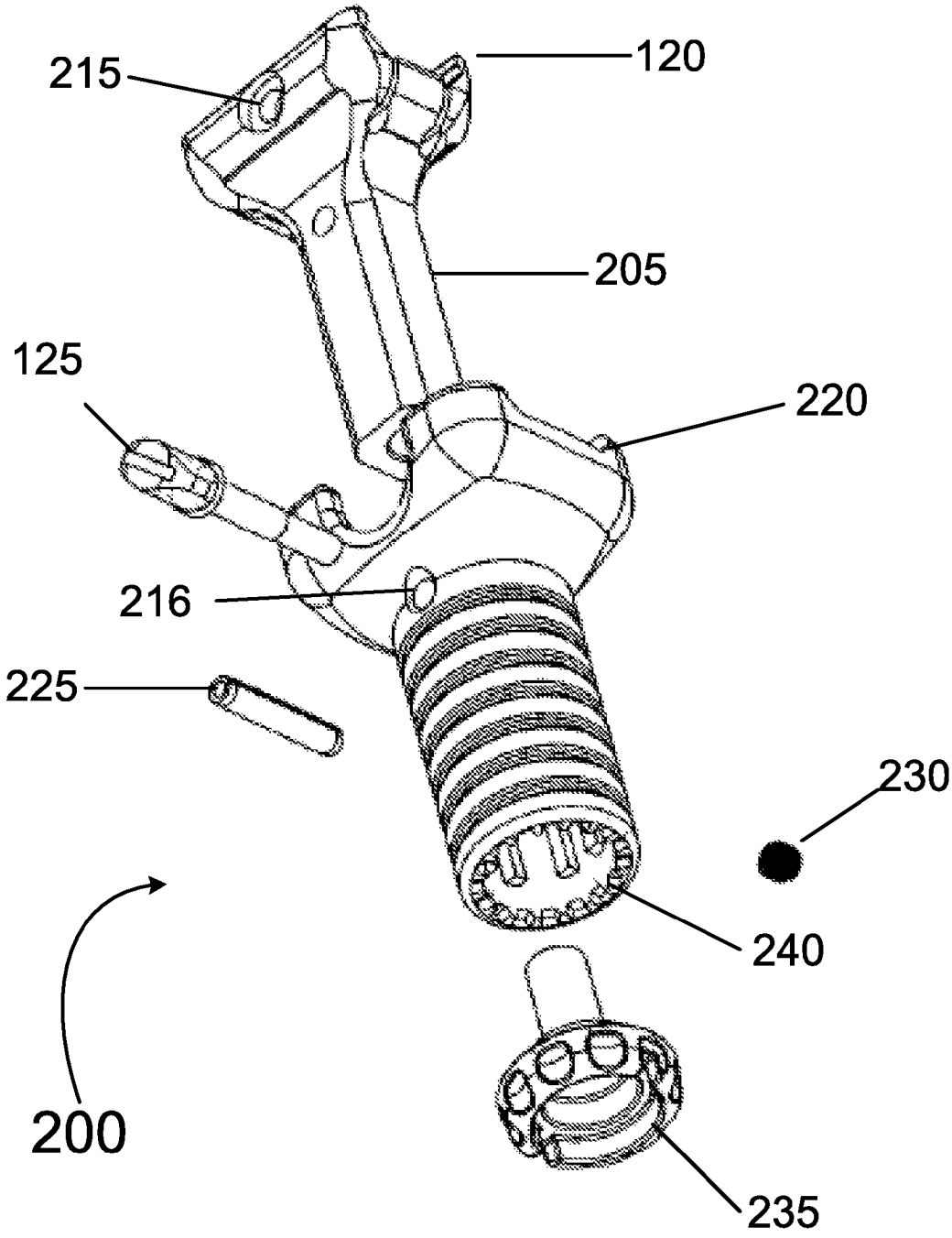
FIG. 2 illustrates a component break-away view of a vertical fore grip according to one embodiment of the invention.

As illustrated in FIGS. 1 and 2, mounting end 110 can be part of a core assembly 205. In this embodiment, mounting end 110 can be adapted to include a clamping mechanism 120 and to receive a thumbscrew 125. In the example embodiment, clamping mechanism 120 can include one or more clamping surfaces 130 for adjustable attachment to a rail assembly. In the example embodiment of FIGS. 1 and 2, clamping mechanism 120 is configured to flex. To attach vertical fore grip 100 and 200 to a rail assembly, clamping mechanism 120 can flex outward so that the width between the clamping surfaces 130, which is sized to receive the grooved dovetail feature of an accessory mounting rail, can expand. Vertical fore grip 100 can be snapped onto the accessory mounting rail at the desired position. Lugs 135 index into grooves on the mounting rail. Once vertical fore grip 100 is in position, the user can tighten thumbscrew 125, bringing clamping surfaces 130 together to exert pressure against the accessory mounting rail and to hold vertical fore grip 100 in place. To accommodate this compression-based attachment, core assembly 205 can include a threaded cavity 215 (which corresponds to cavity 216 in grip body 220 described below) for receiving thumbscrew 125.

As vertical fore grip 100 can be snapped onto the accessory mounting rail, it will be appreciated that vertical fore grip 100 can be snapped off. Such quick attachment and release enables a user to quickly adapt his firearm as necessary by quickly attaching and removing vertical fore grip 100 from the firearm. In addition, in other embodiments, vertical fore grip 100 can be adapted to slide along the length of the rail assembly until a desired position is reached. In such embodiments, clamping surfaces 130 and clamping mechanism 120 can be adapted to slide onto an accessory mounting rail and to slide along the length of the rail assembly. When a desired position is reached, thumbscrew 125 can then be tightened to hold vertical fore grip 100 into position.

Figure 3:
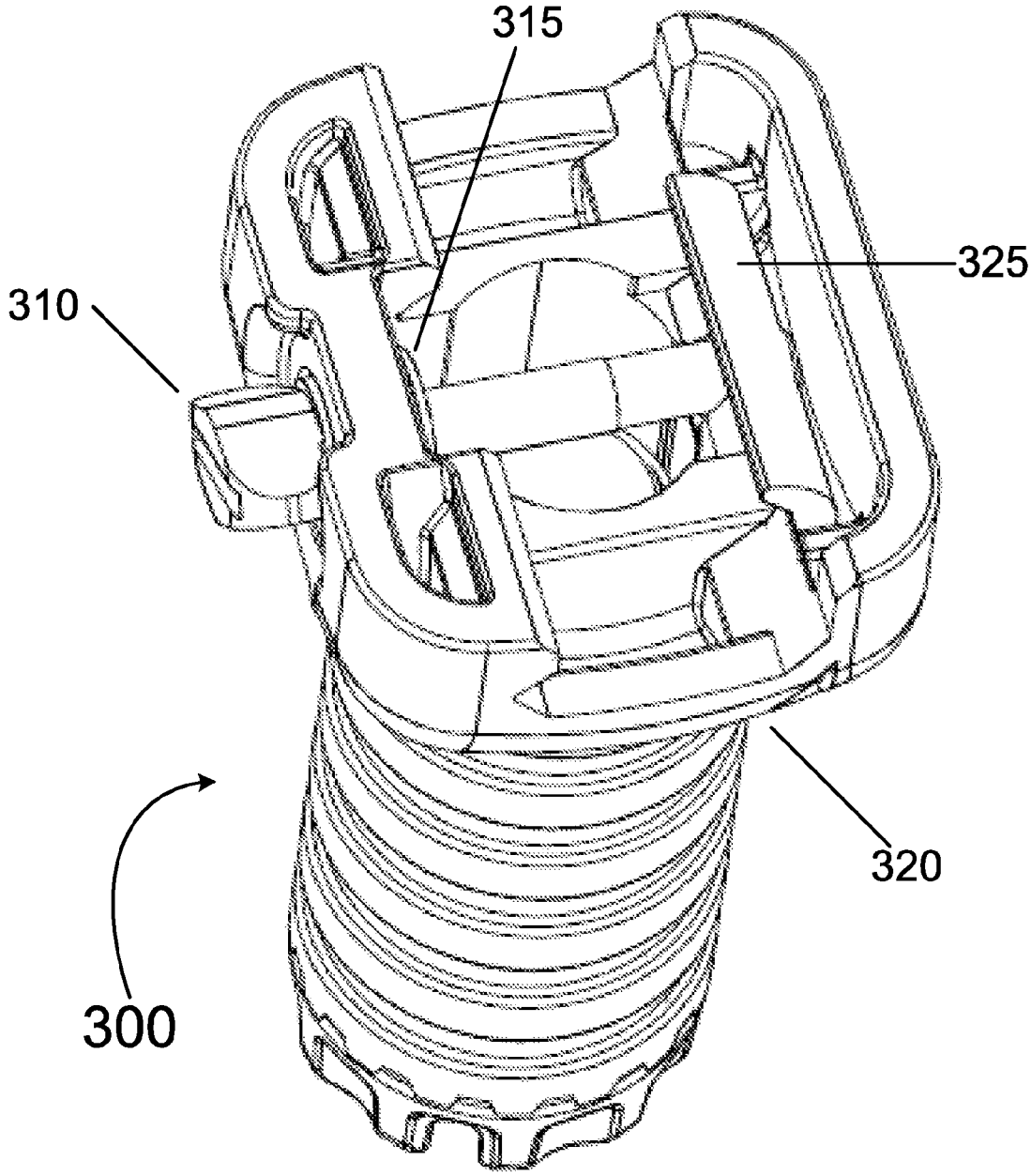
FIG. 3 illustrates a vertical fore grip where certain components have been integrated according to another embodiment of the invention.

Also illustrated in FIG. 2 is grip body 220. Grip body 220 can be concentrically disposed around core assembly 205 and can comprise the outer surface of fore grip section 105. In the example embodiment, vertical fore grip 200 comprises core assembly 205 and grip body 220. In alternative embodiments, rather than be two separate components, core assembly 205 and grip body 220 can be integrated into one single component as shown in FIG. 3. Such embodiments can simplify the manufacturing process, which can reduce the assembly time as well as reduce costs. At the same time, integrated embodiments like those shown in FIG. 3 can be of lighter weight and can accommodate larger tolerances associated with various rail assemblies.

In the example embodiment, grip body 220 can attach around core assembly 205 and be held into position around core assembly 205 using a compression fitting. This compression fitting can be achieved through the sizing of an internal cavity within grip body 220. This internal cavity can be sized to be large enough to fit around core assembly 205, but still be small enough to exert force around core assembly 210 to hold grip body 220 into place. This compression fitting can also be supplemented with other types of attachments. In the example embodiment, a roll pin 225 and threaded insert 230 can be used to provide additional attachment support. Grip body 220 and core assembly 210 can also be adapted to receive roll pin 225 and threaded insert 230. In other embodiments, other types of fasteners known within the art can be used.

Vertical fore grips 100 and 200 in accordance with embodiments of the invention can be manufactured from any number of materials according to the operational requirements of the weapon. For example, the core assembly 205 in vertical fore grip 200 can be machined or casted from aluminum, while grip body 220 can be manufactured from a nylon material. In such an embodiment, the nylon material can act as a heat insulator so that grip body 220 can provide a heat resistant grip for the user. During sustained rapid fire of a firearm, temperatures at the barrel of the firearm can exceed 400° F. In firearms including a hand guard assembly, this extreme amount of heat from the barrel can be conducted into the hand guard and into any accessories attached to a rail assembly on the hand guard. By manufacturing grip body 220 from a nylon material, or other insulating or composite material, the user's hand can be protected from burns that may otherwise be received during intervals of sustained rapid fire.

In other embodiments, vertical fore grips 100 and 200, or any of their component parts, can be manufactured from other materials, including, but not limited to, the following: a metallic alloy, a high impact resistant polymer, a nylon material, a composite material, or a combination of any one or more of these materials.

Vertical fore grip 100 can also include a cap 235. Cap 235 is adapted to fit into an internal cavity accessible from the bottom of core assembly 205. In the example embodiment, the internal cavity of core assembly 205 is threaded, as is cap 235. The threads of cap 235 are adapted to engage the threads of the internal cavity of core assembly 205 and to screw into the cavity. In other embodiments, cap 235 need not be threaded, but can be sized to squeeze within the internal cavity to stay into place. Cap 235 can keep debris, dirt, and grime out of the internal cavity of core assembly 205 when vertical fore grip 100 is in use.

Figure 5:
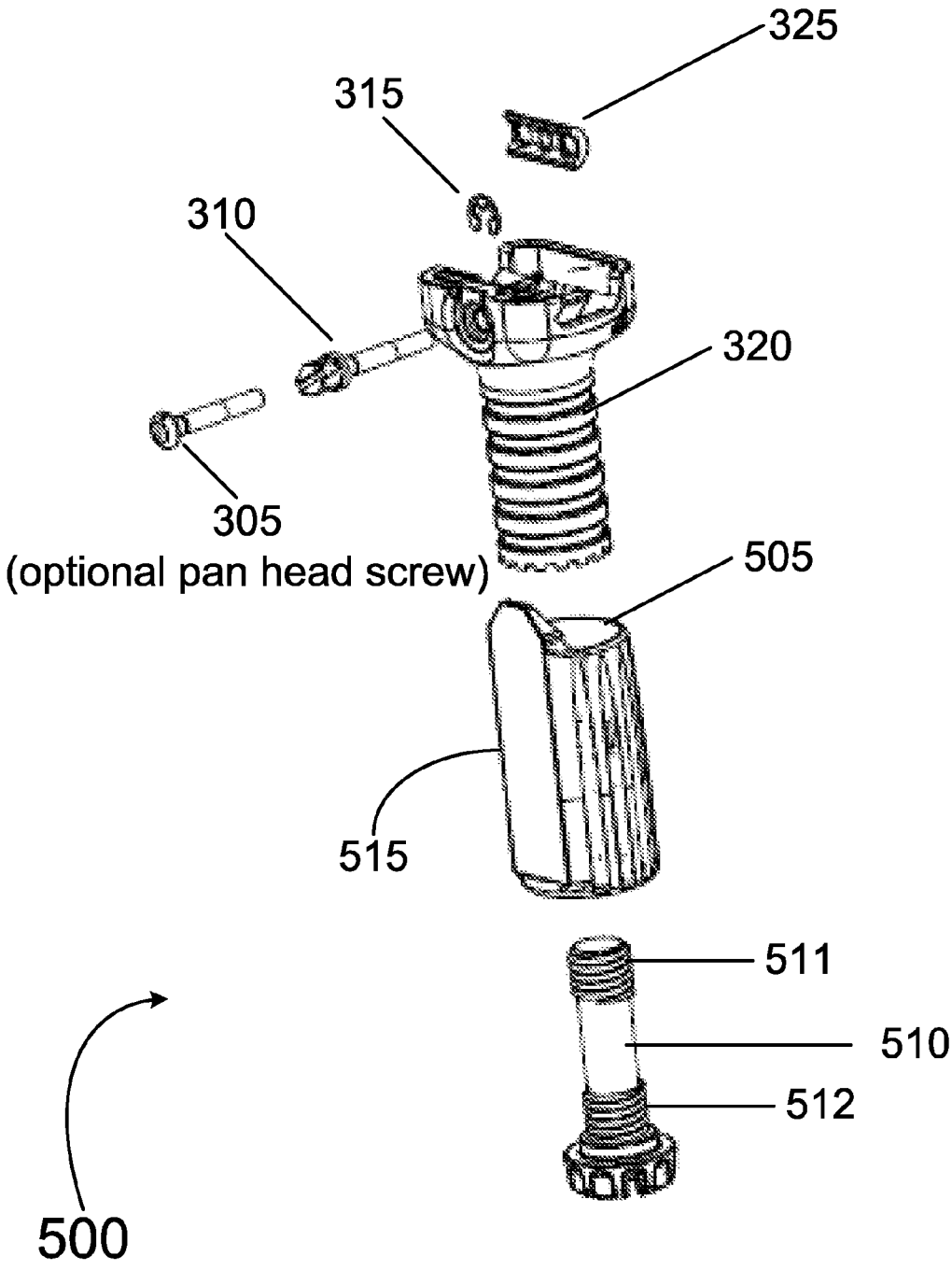
FIG. 5 illustrates an extendable vertical fore grip where certain components have been integrated according to one embodiment of the invention.

In embodiments where core assembly 205 and grip body 220 are manufactured as a single component, a separate attachment mechanism can be used to attach the vertical fore grip to a firearm. In the example embodiment shown in FIG. 3, vertical fore grip 300 can include a clamping mechanism for attachment to a rail assembly. In this embodiment, the clamping mechanism includes a thumbscrew 310, an e-ring 315 adapted to retain thumbscrew 310 in the integrated fore grip section 320, and a rail clamp 325 adapted to fit within a portion of the integrated fore grip section 320. In other embodiments, such as is shown in FIG. 5, thumbscrew 310 can be replaced with optional pan head screw 305. In the example embodiment shown in FIG. 3, inserting the thumbscrew 310 into receiving cavity of integrated fore grip section 320 and into a corresponding threaded cavity of rail clamp 325 allows the clamping mechanism to tighten to the rail assembly so that the vertical fore grip 300 can be secured.

In addition to adjusting the position of these embodiments of vertical fore grip 100 along the length of the firearm, embodiments of the claimed inventions can provide additional user adaptable features. One such feature is an adaptable grip. An adaptable grip can provide one or more grip sizes through varying circumferences along the length of vertical fore grip 100. Another adaptable feature is an adaptable length. Such adaptable features can accommodate the differing preferences or anatomical features of multiple users. In the example embodiment, these adaptable features can be provided by vertical fore grip 400 shown in FIG. 4.

Vertical fore grip 400 comprises vertical fore grip 100 and grip extension 405. Grip extension 405 can taper outward from its top to its bottom so that a user may move his hand up and down grip extension 405 to find a position corresponding to his needs. At the same time, by attaching to the bottom of vertical fore grip 100, grip extension 405 can provide vertical fore grip 400 with a varying length. When compared to the length of vertical fore grip 100, the length of vertical fore grip 400 can be extended to a set, second predetermined length, or it can be extended to a length between a first predetermined length as defined by vertical fore grip 100 and the second predetermined length as defined by the total length of grip extension 405 and vertical fore grip 100. In the embodiment shown, vertical fore grip 400 can provide a vertical grip with a second predetermined length as defined by the total length of grip extension 405 and vertical fore grip 100.

In providing vertical fore grip 400, vertical fore grip 100 can be adapted to attach to grip extension 405 using bolt assembly 410. In the embodiment shown, the internal cavity of core assembly 205 can be adapted with threads to receive bolt assembly 410. Bolt assembly 410 can also include corresponding threads to engage the threads in the internal cavity of core assembly 205. With cap 235 removed, bolt assembly 410 can be inserted into an aperture (not pictured) located in the bottom of grip extension 405, and then attached to vertical fore grip 100. In making this attachment, a user can thread bolt assembly 410 into the cavity of core assembly 205 by turning the head 415 of bolt assembly 410 to engage the threads of the cavity. Grip extension 405, which can be adapted to be concentrically disposed around a portion of fore grip section 105, can engage the bottom of fore grip section 105 when the user has completely tightened bolt assembly 410. By mounting grip extension 405 around vertical fore grip 100 and tightening bolt assembly 410, bolt assembly 410 can hold the combination of vertical fore grip 100 and grip extension 405 together.

In other embodiments, the length of vertical fore grip 400 can be extended to a third length between a first predetermined length as defined by vertical fore grip 100 and the second predetermined length as defined by the total length of grip extension 405 and vertical fore grip 100. In some embodiments, this adaptation can be accomplished using an alternative bolt assembly, such as a telescoping bolt assembly with locking mechanism. In other embodiments, the bolt assembly 410 can be adapted to attach a grip extension of a third length, which can be shorter than grip extension 405.

Another embodiment for providing an extendable vertical fore grip is shown as vertical fore grip 500 in FIG. 5. In the embodiment of FIG. 5, vertical fore grip 300 has been adapted to receive grip extension 505. As described above, vertical fore grip 300 comprises an integrated fore grip section 320 in place of core assembly 205 and grip body 220 found in vertical fore grip 100. In this embodiment, integrated fore grip section 320 has been configured to include a threaded cavity (not pictured) to receive capping bolt 510. Capping bolt 510 comprises a set of upper threads 511 and a set of lower threads 512 and can engage the threads of the threaded cavity in integrated fore grip section 320 to serve at least two purposes. When grip extension 505 is not attached to vertical fore grip 300, lower threads 512 of capping bolt 510 can engage the threads of the threaded cavity and can seal the threaded cavity of integrated fore grip section 320 so that debris can not enter the cavity. When grip extension 505 is attached to vertical fore grip 300, upper threads 511 of capping bolt 510 can secure the combination of grip extension 505 and integrated fore grip section 320 together by engaging the threads of the threaded cavity. In doing so, vertical fore grip 500 can be provided, which is an extendable embodiment of vertical fore grip 300.

As previously mentioned, the rise in non-conventional operations has increased the need for modern weapons to be adaptable within a wide range of operational requirements. To accommodate this need, certain modern weapons have been adapted to include any number of accessories. In embodiments of the vertical fore grip provided herein, the vertical fore grip can be adaptable to accommodate this need as well. Moreover, certain embodiments can also be adaptable to accommodate the user's own dexterity or preference for right hand or left hand accessibility of the one or more mounted accessories.

Figure 4:
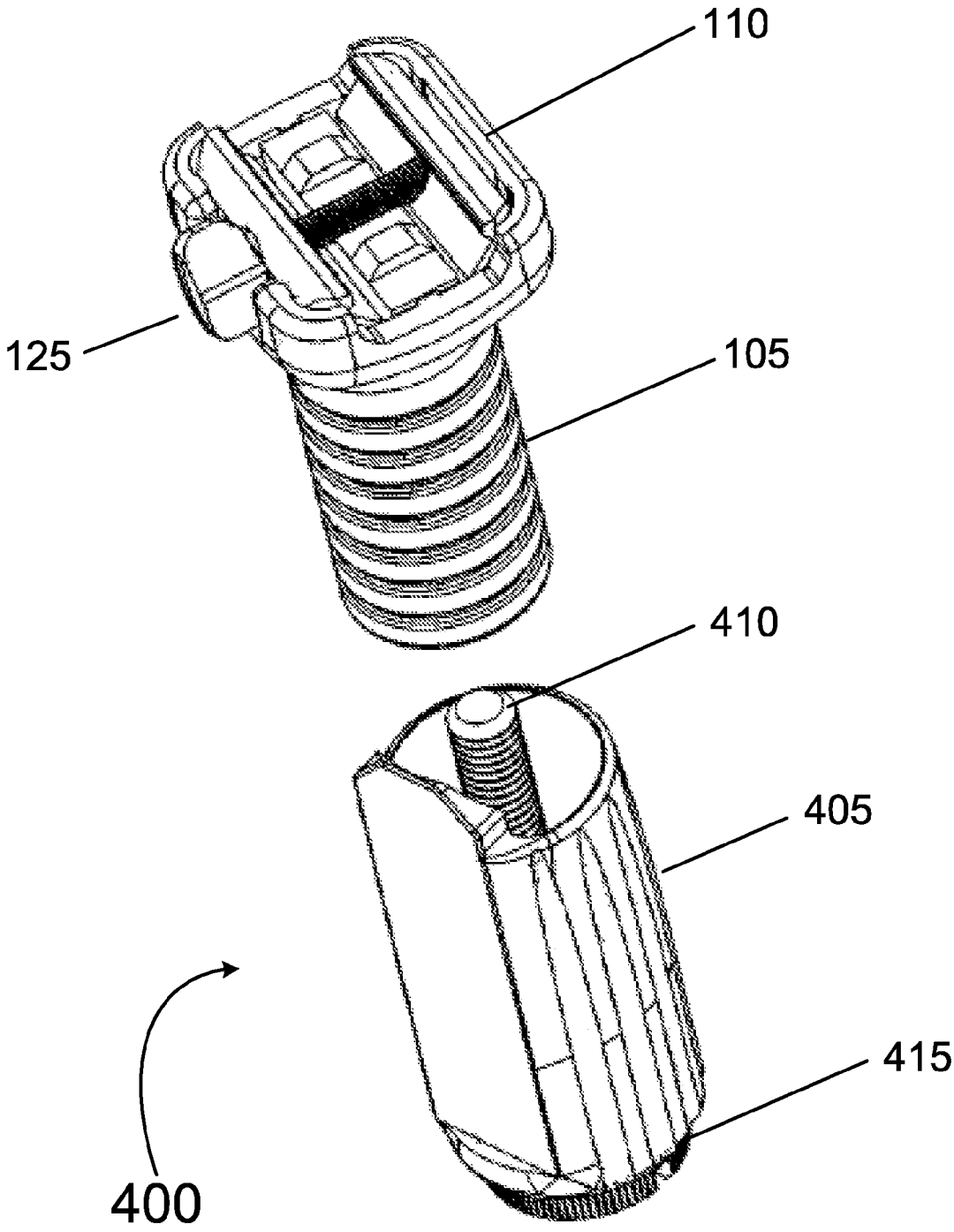
FIG. 4 illustrates a component break-away view of an extendable vertical fore grip according to one embodiment of the invention.
Figure 6:
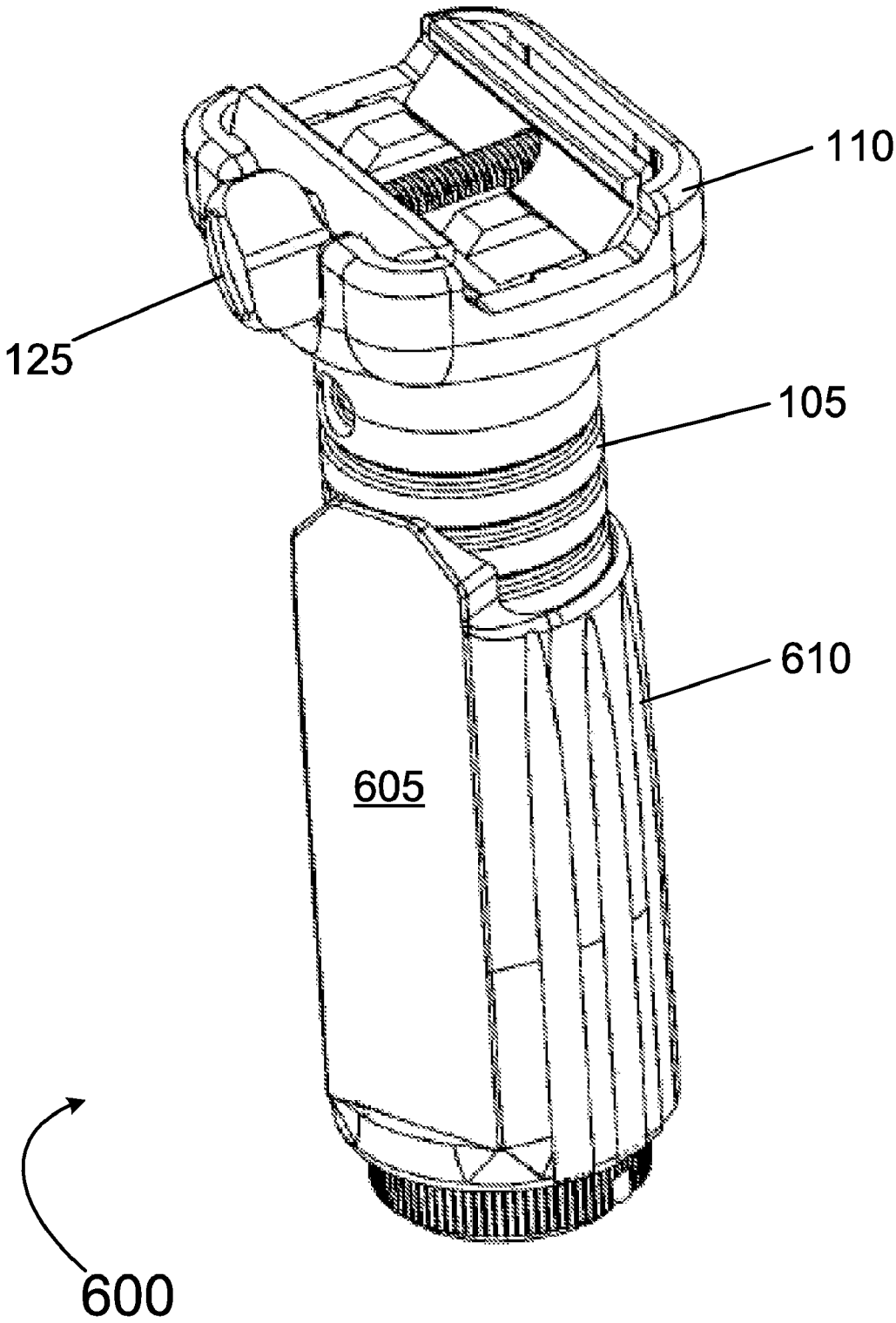
FIG. 6 illustrates an extendable vertical fore grip adapted to mount at least one accessory according to one embodiment of the invention.

FIG. 6 illustrates an assembled view of the components comprising vertical fore grip 400, shown in FIG. 4, as a fully assembled vertical fore grip 600. Vertical fore grip 600 provides an embodiment that can be adapted to include one or more accessories. In the embodiment shown, one or more accessories can be mounted along flat surface area mounting section 605. To mount an accessory to mounting section 605, an appropriate fastener can be used. Such fasteners can include, but are not limited to, the following: adhesive tape; Velcro tape; zip ties, adhesive; bicycle inner tubes; and rubber bands. A similar flat surface area for mounting one or more accessories is also shown in FIG. 5 at 515.

In the embodiment shown, one accessory that can be mounted to vertical fore grip 600 is a pressure pad or switch for a laser sight, such as the membrane style pressure switch for the AN/PEQ-5 laser sight provided by Insight Technology. The AN/PEQ-5 is a laser sight manufactured by Insight Technologies and configured to project a visible red dot on a designated target. Other laser sights can also be used such as the AN/PEQ-2, which includes an infrared illuminator/target designator and is only visible through the AN/PEQ-2 night vision system or infrared imaging systems. Both of these laser sights can mount to a rail assembly, and they can be controlled by a membrane style pressure switch, such as the ITI™ PEQ 5 Switch also provided by Insight Technology. In other embodiments of vertical fore grip 600, other switches that correspond to other targeting and illumination systems can be used, such as the SureFire™ switch used in the M951 KIT02 Millenium Universal WeaponLight System™. In addition to a pressure pad or switch for operating a laser sight, other accessories can be adapted to attach to vertical fore grip 600 at mounting section 605, such as the AN/PEQ-15 Advanced Target Pointer Illuminator Aiming Light.

When mounting an accessory to vertical fore grip 600, a user may find it necessary to alter the position of the accessory to meet his anatomical requirements or preferences. For example, a user who is left handed is likely to prefer a different position of the accessory mounted to vertical fore grip 600 than a user who is right handed. Similarly, one user may prefer to operate the accessory with his thumb, while another may prefer to use his forefinger. In both instances, altering vertical fore grip 600 to accommodate these preferences is desired.

In vertical fore grip 600, grip extension 610 can be altered to accommodate the user's preference for positioning of the mounted accessory. In the embodiment shown, the user can rotate grip extension 610 circumferentially so that a user, whether he be right handed, left handed, or ambidextrous, can position the accessory accordingly. In the embodiment shown, grip extension 610 can be rotated 360 degrees, which can allow a user to adjust the position of the mounted accessory so that it is accessible by any finger or portion of his hand.

Figure 7:
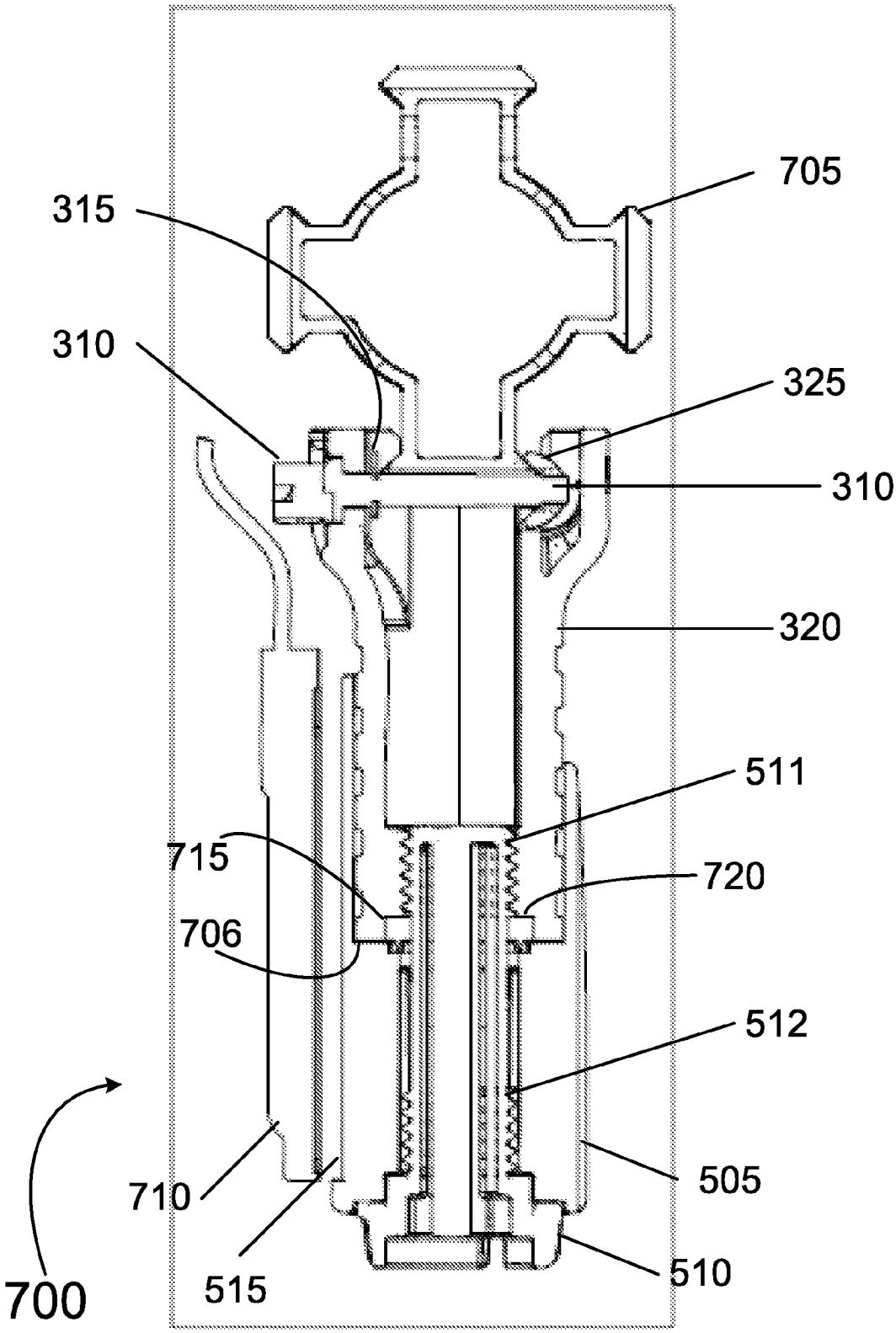
FIG. 7 illustrates an extendable vertical fore grip that can mount at least one accessory and that can be altered to adapt to the needs of a user, according to one embodiment of the invention.

Example structural features providing for this rotation are shown in FIG. 7 in a cross section illustration of vertical fore grip 500. In FIG. 7, vertical fore grip 500 has been mounted to a rail assembly 705 using the clamping mechanism that includes a thumbscrew 310, an e-ring 315, and rail clamp 325, which is adapted to fit within a portion of integrated fore grip section 320. Vertical fore grip 500 includes grip extension 505 that is secured to integrated fore grip section 320 with capping bolt 510. In particular, upper threads 511 of capping bolt 510 engage corresponding threads in threaded cavity 320 until the bottom of fore grip section 320 abuts rim 706 encircling the interior of grip extension 505. Grip extension 505 also includes a flat surface area 515 for mounting at least one accessory 710.

Around the inner surface of grip extension 505 are a series of teeth 715 protruding from rim 706 and configured to interact with a series of ridges 720 in fore grip section 320 (also shown in FIG. 2 at 240). When capping bolt 510 secures grip extension 505 to integrated fore grip section 320, the bottom of fore grip section 320 abuts rim 706 so that the teeth at 715 can interlock with the ridges at 720. This interconnectedness between teeth 715 and the ridges at 720 can secure grip extension 505 in rotational relation to integrated grip section 320. To rotate grip extension 505, a user can loosen capping bolt 510 so that the bottom of integrated fore grip section 320 no longer abuts rim 706. Without this abutment, teeth 715 are released from the ridges at 720. The user can then rotate grip extension 505 to the appropriate position and can tighten capping bolt 510 when the desired position is reached. In the example embodiment, grip extension can be rotated 360 degrees and positioned in approximately 22.5 degree increments. That is, the user can loosen grip extension 505, turn it 22.5 degrees, and retighten capping bolt 510 to secure grip extension 505 into place. Although in the example embodiment grip extension 505 is configured to be repositioned 360 degrees in approximately 22.5 degree increments, it will be understood that any size increments can be used.

While particular embodiments of systems and methods for adapting a vertical fore grip to a user have been disclosed in detail for purposes of example, those skilled in the art will understand that variations and modifications may be made without departing from the scope of the disclosure. All such variations and modifications are intended to be included within the scope of the present disclosure, as protected by the following claims.

The claimed invention is:

1. A system configured for adapting a vertical fore grip to a user, the system comprising: a vertical fore grip comprising a clamping mechanism configured to adjustably attach to a firearm; a grip extension configured to modify the vertical fore grip, wherein the grip extension is further configured to mount at least one accessory; and a bolt assembly configured for adjustably attaching the grip extension to the vertical fore grip, wherein the bolt assembly is configured to permit the grip extension to rotate in relation to the vertical fore grip, wherein the grip extension comprises a series of teeth, and the vertical fore grip comprises a series of ridges to interact with said teeth to control rotation of the grip extension in relation to the vertical fore grip.

2. The system of claim 1, wherein the said ridges and said teeth are configured to control rotation of the grip extension in relation to the vertical fore grip at a predetermined increment.

3. The system of claim 2, wherein the predetermined increment is about 22.5 degrees.

4. A method for adapting a vertical fore grip to a user, the method comprising: adjustably attaching a vertical fore grip to a firearm using a clamping mechanism; modifying the vertical fore grip by attaching a grip extension to the vertical fore grip with a bolt assembly, wherein the grip extension is configured to mount at least one accessory; and adjusting the grip extension in relation to the vertical fore grip using the at least one bolt assembly, wherein the bolt assembly permits the grip extension to rotate in relation to the vertical fore grip, wherein the grip extension comprises a series of teeth, and the vertical fore grip comprises a series of ridges to interact with said teeth to control rotation of the grip extension in relation to the vertical fore grip.

5. The method of claim 4, further comprising mounting at least one accessory to the grip extension.

6. The method of claim 4, wherein adjustably attaching the vertical fore grip to a firearm comprises adjusting the vertical fore grip along a length of the firearm.

7. The method of claim 4, further comprising rotating the grip extension in relation to the vertical fore grip at a predetermined increment.

8. The method of claim 7 wherein the predetermined increment is about 22.5 degrees.

9. An apparatus configured for use with a vertical fore grip, the apparatus comprising: a clamping mechanism configured to receive at least a portion of a firearm mounting rail; a plurality of lugs configured to mount to a corresponding plurality of grooves associated with the firearm mounting rail; and at least one tightening device configured to exert a pressure against the firearm mounting rail and to mount the vertical fore grip relative to the firearm mounting rail, and a bolt assembly configured for adjustably attaching a grip extension to the vertical fore grip, wherein the bolt assembly is configured to permit the grip extension to rotate in relation to the vertical fore grip, wherein the grip extension comprises a series of teeth, and the vertical fore grip comprises a series of ridges to interact with said teeth to control rotation of the grip extension in relation to the vertical fore grip.

* * * * *